US005950637A

United States Patent [19]

Chang

[11] Patent Number: 5,950,637

[45] Date of Patent: Sep. 14, 1999

[54] HAIR HOLDING DEVICE

[76] Inventor: Wen Hsiung Chang, No. 7, Alley 116, Lane 175, Sec. 1, Ta Tung Rd., Tainan City, Taiwan

[21] Appl. No.: 09/249,592

[22] Filed: Feb. 16, 1999

[51] Int. Cl.[6] ..... A45D 8/36

[52] U.S. Cl. ..... 132/273; 132/54

[58] Field of Search ..... 132/212, 273, 132/274, 275, 54; 63/5.1

[56] References Cited

U.S. PATENT DOCUMENTS

| | | | |
|---|---|---|---|
| 2,775,245 | 12/1956 | Behr | 132/273 |
| 3,209,768 | 10/1965 | Goodman | 132/273 |
| 3,746,016 | 7/1973 | Goodman | 132/273 |

*Primary Examiner*—Todd E. Manahan
*Attorney, Agent, or Firm*—Charles E. Baxley, Esq.

[57] ABSTRACT

A hair holding device includes a number of first plates and a corresponding number of second plates arranged in an annular manner. Each first plate is engaged with three second plates, and each second plate engages with three first plates. Each second plate includes a fastening member formed on a first lateral side thereof and an engaging member formed on a second lateral side thereof such that the engaging member of each second plate may releasably receive the fastening member of an adjacent second plate. The engaging member includes two flexible pieces projected from the second side of the second plate and having a receiving compartment therebetween. Each flexible piece has an engaging tooth formed on a side thereof that faces the other flexible piece. In addition, the fastening member includes a number of teeth on each of two sides thereof so as to be selectively engaged with the engaging teeth of the flexible pieces. The distance between two adjacent second plates can be adjusted for holding hairs of different amount. The hair holding effect is also improved by adjusting the distance between two adjacent second plates.

6 Claims, 6 Drawing Sheets

HAIR HOLDING DEVICE

BACKGROUND OF THE INVENTION

1. Field of the Invention

The present invention relates to a hair holding device for hairs of different amount.

2. Description of the Related Art

FIG. 8 of the drawings illustrates a typical hair holder that includes a plurality of first plates 1' and a corresponding number of second plates 2'. Each first plate 1' includes three pegs 11' formed on a side thereof, while each second plate 2' includes three holes 21'. Each first plate 1' engages with three adjacent second plates 2', while each second plate 2' engages with three adjacent first plates 1'. The first plates 1' and the second plates 2' together form a cone and define a space 3' in a center thereof for receiving the hair of a user, as shown in FIG. 9. When in use, the user may expand the hair holder to make the space 3' larger for receiving her hair, and the hair holder is then collapsed to reduce the space 3' and thus holds the hair, as shown in FIG. 10. However, the engaging effect between the peg 11' and the hole 21' is not satisfactory such that disengagement between the first plate 1' and the second plate 2' often occurs when the space 3' is made larger during outward expansion of the hair holder. The present invention is intended to provide an improved hair holding device that mitigates and/or obviates the above problems.

SUMMARY OF THE INVENTION

It is a primary object of the present invention to provide a hair holding device comprising a plurality of first plates and a corresponding number of second plates of the type mentioned above. Each second plate includes a fastening member formed on a first lateral side thereof and an engaging member formed on a second lateral side thereof such that the engaging member of each second plate may releasably receive the fastening member of an adjacent second plate. In an alternative embodiment of the invention, the engaging member and the fastening member are formed on each of the first plates, rather than the second plates. In a preferred embodiment of the invention, the engaging member includes two flexible pieces projected from the second side of the second plate and having a receiving compartment therebetween. Each flexible piece has an engaging tooth formed on a side thereof that faces the other flexible piece. In addition, the fastening member includes a plurality of teeth on each of two sides thereof so as to be selectively engaged with the engaging teeth of the flexible pieces. Thus, the distance between two adjacent second plates can be adjusted for holding hairs of different amount. The hair holding effect is also improved by adjusting the distance between two adjacent second plates.

Each second plate may further include a plurality of pin-like protrusions on an inner side thereof. The protrusions may stick into the hair of the user to provide a more reliable hair holding effect.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
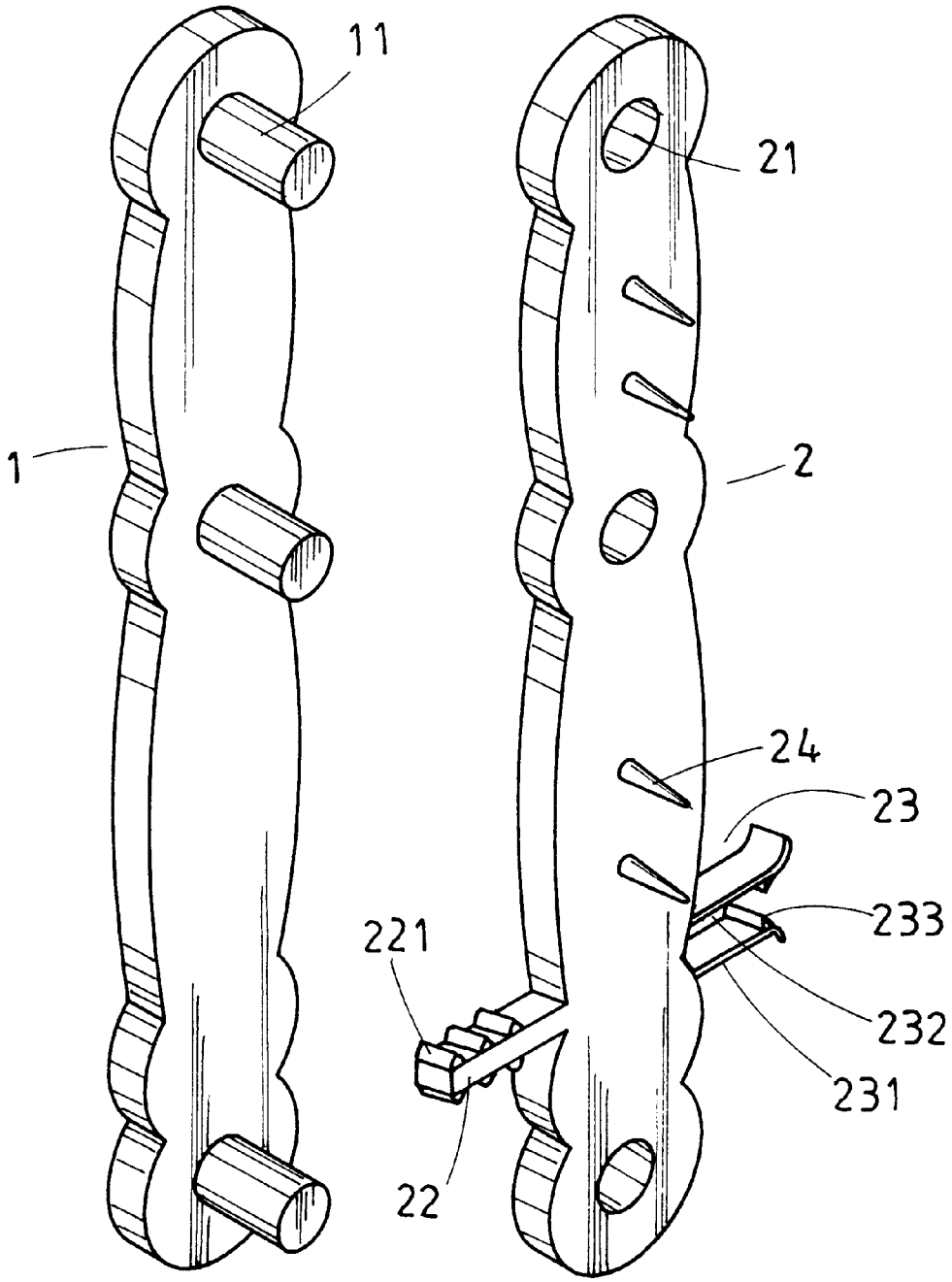
FIG. 1 is a perspective view illustrating a first plate and a second plate of a hair holding device in accordance with the present invention.
Figure 2:
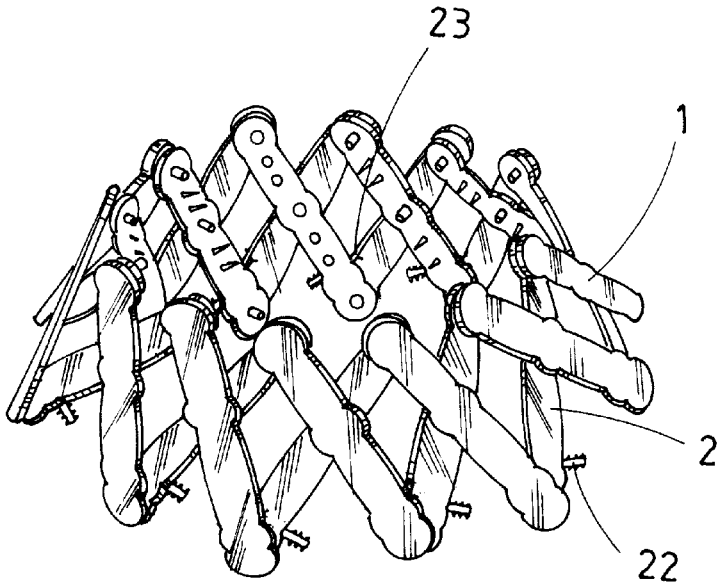
FIG. 2 is a perspective view of the hair holding device in accordance with the present invention.

Referring to FIGS. 1 to 7 and initially to FIG. 2, a hair holding device in accordance with the present invention generally includes a plurality of first plates 1 and a corresponding number of second plates 2 arranged in an annular manner. Each first plate 1 includes three pegs 11 while each second plate 2 includes three holes 21, as shown in FIG. 1. Each first plate 1 engages with three adjacent second plates 2. As can be seen from FIG. 2, for each first plate 1 and the three second plates 2 engaged therewith, the uppermost peg 11 of the first plate 1 engages with an uppermost hole 21 of the leftmost second plate 2, the middle peg 11 of the first plate 1 engages with the middle hole 21 of the middle second plate 2, and the lowermost peg 11 of the first plate 1 engages with the lowermost hole 21 of the rightmost second plate 2. Each second plate 2 also engages with three adjacent first plates 1. As can be seen from FIG. 2, for each second plate 2 and the three first plates 1 engaged therewith, the uppermost hole 21 of the second plate 2 engages with the uppermost peg 11 of the rightmost first plate 1, the middle hole 21 of the second plate 2 engages with the middle peg 11 of the middle first plate 1, and the lowermost hole 21 of the second plate 2 engages with the lowermost peg 11 of the leftmost first plate 1.

As can be seen from FIG. 1, each second plate 2 further includes a fastening member 22 formed on a first lateral side thereof and an engaging member 23 formed on a second lateral side thereof. The fastening member 22 includes a plurality of teeth 221 on each of two sides thereof. The engaging member 23 includes two flexible pieces 231 projected outwardly from the second lateral side of the second plate 2 and having a receiving compartment 232 therebetween. Each flexible piece 231 includes an engaging tooth 233 formed on an inner face that faces the other flexible piece 231.

Figure 3:
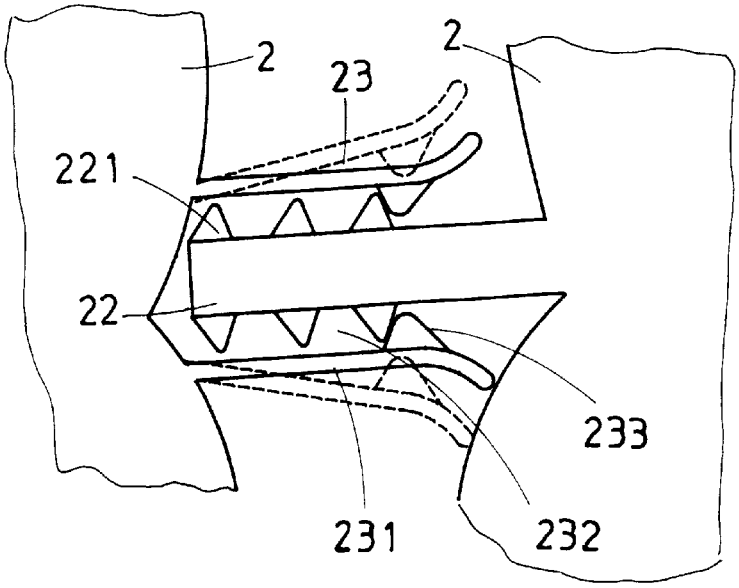
FIG. 3 is an enlarged view illustrating engagement between two adjacent second plates.
Figure 4:
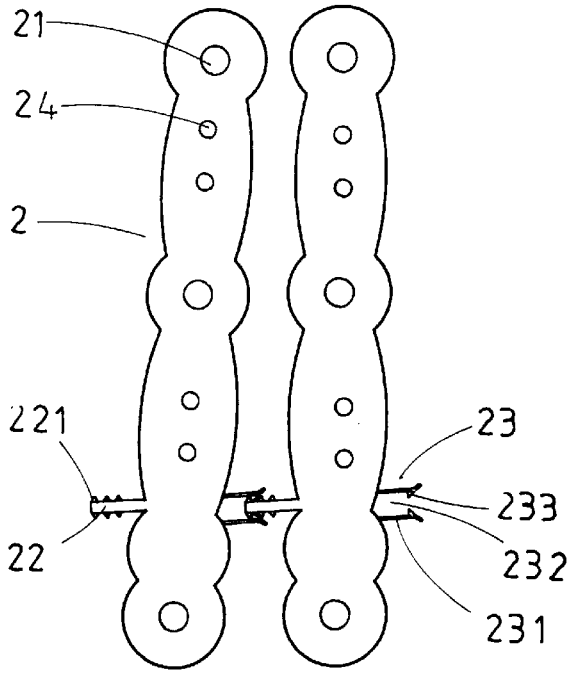
FIG. 4 is a side view illustrating engagement between two adjacent second plates.
Figure 5:
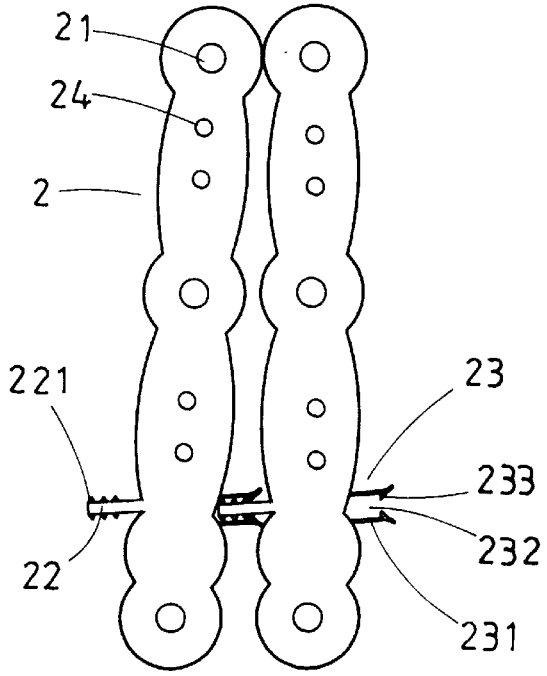
FIG. 5 is a side view similar to FIG. 4, wherein the second plates are more close to each other.
Figure 6:
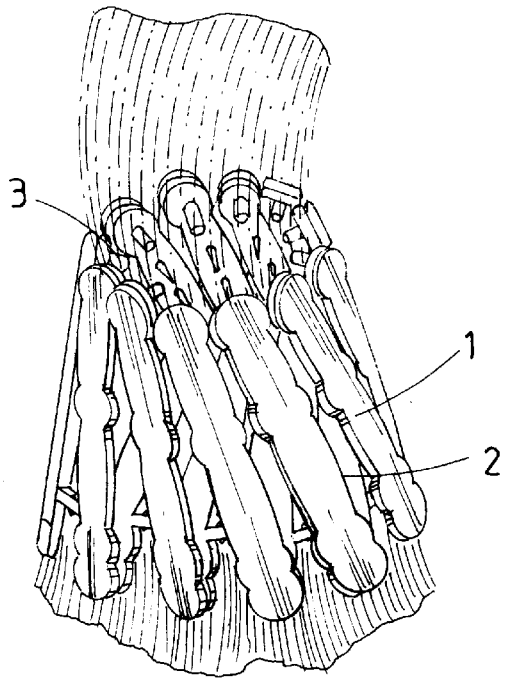
FIG. 6 is a schematic view illustrating a use of the hair holding device in accordance with the present invention.
Figure 7:
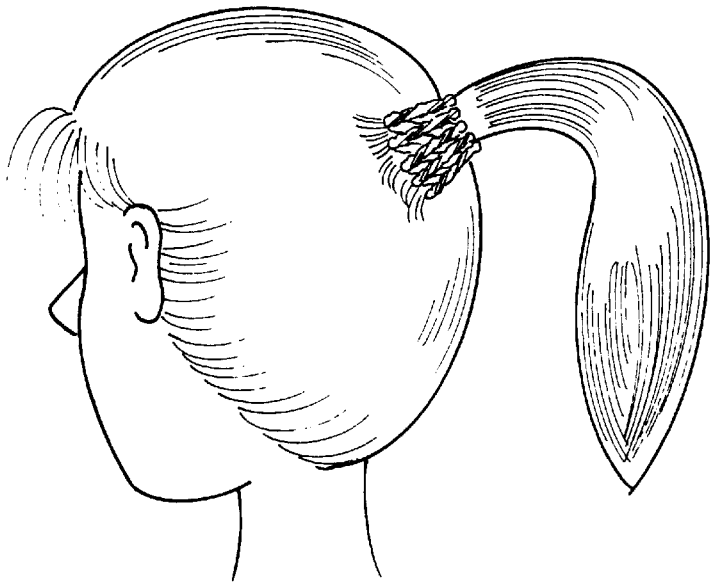
FIG. 7 is a schematic view illustrating another use of the hair holding device in accordance with the present invention.

Referring to FIG. 3, the engaging member 23 of a second plate 2 may releasably engage with the fastening member 22 of an adjacent second plate 2. In addition, the teeth 221 of the fastening member 22 are selected to engage with the engaging teeth 233 of the engaging member 23 to allow adjustment of the distance between each two adjacent second plates 2. Referring to FIGS. 4 and 5, the second plates 2 in FIG. 5 are more close to each other than those in FIG. 4 for holding more hair. Referring to FIG. 6, the hair holding device includes a space 3 in a center thereof that is defined by the first plates 1 and the second plates 2. FIG. 7 illustrates another use of the hair holding device. Removal of the hair holding device is simple after disengaging the fastening member 22 from the engaging member 23 and expanding the hair holding device. Such disengagement can be easily accomplished, as the engaging member 23 is flexible.

Referring to FIG. 2, each second plate 2 may include a plurality of pin-like projections 24 on an inner side thereof. The protrusions 24 may stick into the hair of the user to provide a more reliable hair holding effect.

Figure 8:
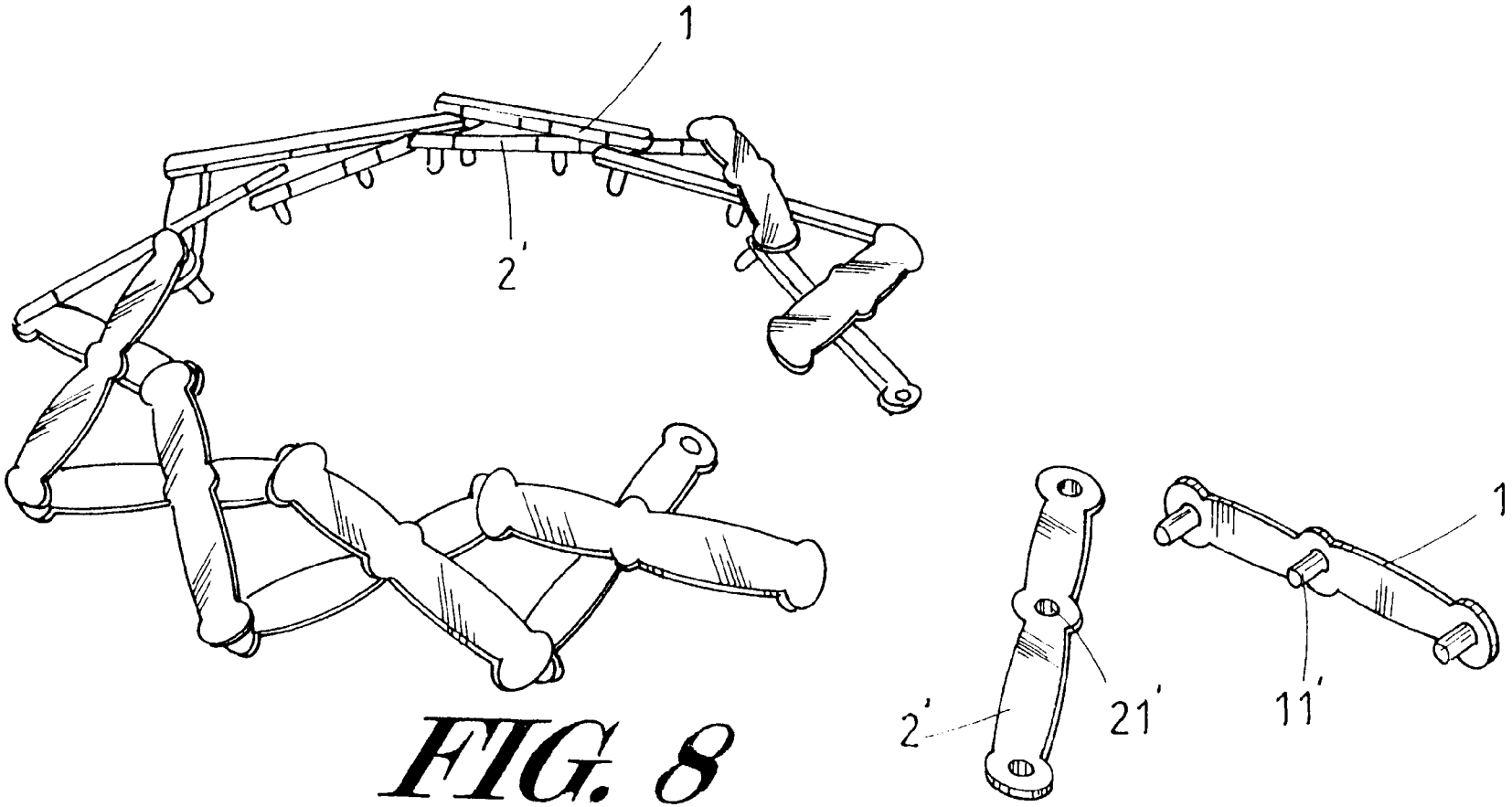
FIG. 8 PRIOR ART
FIG. 8 is a perspective view, partly exploded, of a conventional hair holder.
Figure 9:
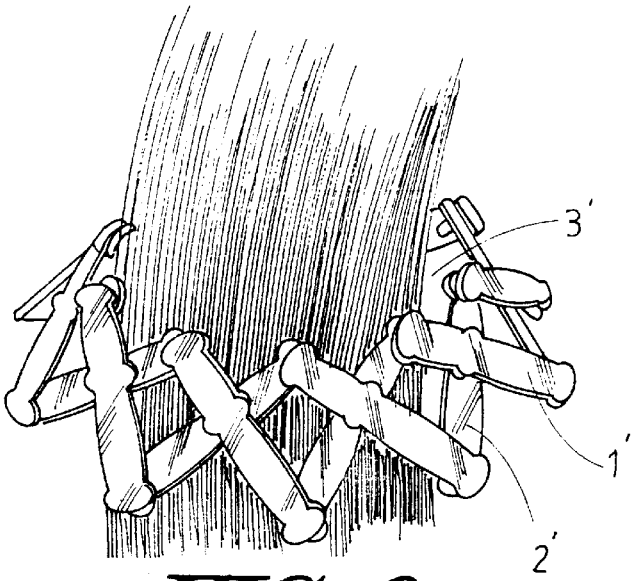
FIG. 9 PRIOR ART
FIG. 9 is a schematic view illustrating a first step of use of the hair holding device in FIG. 8.
Figure 10:
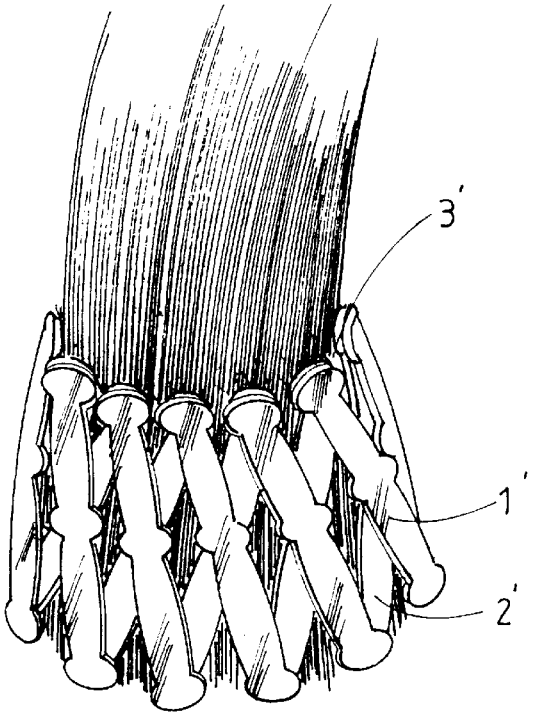
FIG. 10 PRIOR ART
FIG. 10 is a schematic view illustrating a hair held by the hair holding device in FIG. 8.

It is not necessary to have all of the second plates 2 equipped with the engaging member 23 and the fastening member 22. A hair holding device in accordance with the present invention may incorporate some conventional second plates 2' shown in FIG. 8. In addition, the engaging member 23 and the fastening member 22 may be provided on the first plate 1 instead of the second plate 2. Furthermore, both the first plate 1 and the second plate 2 may have the engaging member 23 and the fastening member 22 formed thereon.

Although the invention has been explained in relation to its preferred embodiment, it is to be understood that many other possible modifications and variations can be made without departing from the spirit and scope of the invention as hereinafter claimed.

What is claimed is:

1. A hair holding device comprising a plurality of first plates and a corresponding number of second plates arranged in an annular manner, each said first plate including three pegs, each said second plate including three holes, each said first plate engaging with three adjacent said second plates, each said second plate engaging with three adjacent said first plates, the improvements comprising:

each said second plate including a fastening member formed on a first lateral side thereof and an engaging member formed on a second lateral side thereof, the fastening member of each said second plate being releasably engaged with the engaging member of an adjacent said second plate.

2. The hair holding device as claimed in claim 1, wherein the fastening member includes a plurality of teeth on each of two sides thereof, and the engaging member includes two flexible pieces projected outwardly from the second lateral side of the second plate, the flexible pieces a receiving compartment therebetween for releasably receiving the teeth of the fastening member, each said flexible piece including an engaging tooth formed on an inner face that faces the other flexible piece, the teeth of the fastening member being selectively engaged with the engaging teeth of the flexible pieces to allow adjustment of the distance between each two adjacent said second plates.

3. The hair holding device as claimed in claim 1, wherein the second plate includes a plurality of protrusions that stick into the hair of the user to provide increased hair holding effect.

4. A hair holding device comprising a plurality of first plates and a corresponding number of second plates arranged in an annular manner, each said first plate including three pegs, each said second plate including three holes, each said first plate engaging with three adjacent said second plates, each said second plate engaging with three adjacent said first plates, the improvements comprising:

each said first plate including a fastening member formed on a first lateral side thereof and an engaging member formed on a second lateral side thereof, the fastening member of each said first plate being releasably engaged with the engaging member of an adjacent said first plate.

5. The hair holding device as claimed in claim 4, wherein the fastening member includes a plurality of teeth on each of two sides thereof, and the engaging member includes two flexible pieces projected outwardly from the second lateral side of the first plate, the flexible pieces a receiving compartment therebetween for releasably receiving the teeth of the fastening member, each said flexible piece including an engaging tooth formed on an inner face that faces the other flexible piece, the teeth of the fastening member being selectively engaged with the engaging teeth of the flexible pieces to allow adjustment of the distance between each two adjacent said first plates.

6. The hair holding device as claimed in claim 4, wherein the second plate includes a plurality of protrusions that stick into the hair of the user to provide increased hair holding effect.

* * * * *